United States Patent [19]

Hayward

[11] 4,206,573

[45] Jun. 10, 1980

[54] TUMBLING APPARATUS

[76] Inventor: Walter W. Hayward, 1805 Ponderosa Pl., Loveland, Colo. 80537

[21] Appl. No.: 579

[22] Filed: Jan. 2, 1979

Related U.S. Application Data

[63] Continuation of Ser. No. 680,219, Apr. 26, 1976, abandoned.

[51] Int. Cl.[2] ..... B24B 31/02

[52] U.S. Cl. ..... 51/164.1; 366/219

[58] Field of Search ..... 51/164, 7; 68/141; 366/208, 209, 215–217, 219

[56] References Cited

U.S. PATENT DOCUMENTS

| | | | |
|---|---|---|---|
| 58,487 | 10/1866 | Sawyer | 51/316 |
| 1,913,979 | 6/1933 | Farrington | 51/164 X |
| 1,933,455 | 10/1933 | Sommers | 51/164 X |
| 3,408,774 | 11/1968 | Engel | 51/163.1 |

FOREIGN PATENT DOCUMENTS

| | | | |
|---|---|---|---|
| 231338 | 7/1969 | U.S.S.R. | 51/164 |

*Primary Examiner*—Harold D. Whitehead
*Attorney, Agent, or Firm*—Hugh H. Drake

[57] ABSTRACT

Apparatus for tumbling rocks or the like has a generally-cylindrical canister with a longitudinal axis and a transverse axis that intersects that longitudinal axis at a right angle thereto. The canister is mounted so as to revolve around its longitudinal axis, and the canister is driven in revolution around the axis. The orientation of the longitudinal axis is adjustable between a first position wherein that axis remains in a horizontal plane as the canister revolves about the longitudinal axis and a second position wherein the longitudinal axis wobbles relative to the horizontal plane as the canister so revolves. In one form, the canister is seated within a yoke so as to revolve around its longitudinal axis, with that yoke being driven to effect its rotation about the aforementioned transverse axis. In another form, the canister is mounted within a gimbal ring within which the canister is pivotally mounted so as to rotate about its transverse axis.

35 Claims, 22 Drawing Figures

TUMBLING APPARATUS

RELATED APPLICATION

This is a continuation of application Ser. No. 680,219, filed Apr. 26, 1976, now abandoned.

The present invention pertains to tumbling apparatus. More particularly, it relates to apparatus for containing rocks or other material and causing the same to tumble or mix in a selectively adjustable manner.

For the purpose of polishing mineral specimens to be used in jewelry and the like, it is known to place these specimens into a container along with an abrasive material and then rotate the container so as to "tumble" the specimens continually and repeatedly through the abrasive material. At least somewhat similar rotating-container apparatus often is used for the purpose of mixing chemical constituents or deburring the surfaces of mechanical parts.

One frequently employed form of rock tumbler simply utilizes a cylindrical canister into which the rocks and abrasive material are placed. The canister is then placed into a driving apparatus that causes the tumbler to revolve around its longitudinal axis. In many cases, a comparatively coarse abrasive material is first employed, with successively finer abrasive materials being substituted as the overall process is continued. With typical rock specimens, the total time required to achieve the ultimate finished product is quite lengthy and may extend for a period of some days.

In an effort to decrease the total time requirement, it has been known to so mount the container or canister that one end thereof gyrates in a circle about which otherwise would be a nominal centerline. The added gyrational movement serves to increase the abrasive action and, thereby, reduce the total time required to obtain the desired results. However, the increased degree of tumbling action also can render it difficult to achieve as high a degree of ultimate polish as may be desired. In addition, the apparatus utilized to effect such gyrational movement can significantly increase the complexity and costs of the apparatus.

It is, accordingly, a general object of the present invention to provide a new and improved rock tumbler or the like which permits the achievement of results as desired in the aforementioned prior apparatus while overcoming certain of the disadvantages therein encountered.

Another object of the present invention is to provide new and improved forms of such tumblers which are simple and efficient in operation while at the same time being capable of being produced at comparatively modest cost.

A further object of the present invention is to provide new and improved forms of such tumblers which enable a high degree of flexibility in usage.

Tumbling apparatus constructed in accordance with the present invention includes a generally-cylindrical canister that has a longitudinal axis and a transverse axis intersecting the longitudinal axis at a right angle thereto. Included are means for mounting the canister so as to revolve about its longitudinal axis. The orientation of that longitudinal axis is adjustable between a first position wherein the longitudinal axis remains in a horizontal plane as the canister revolves about the same longitudinal axis and a second position wherein the longitudinal axis wobbles relative to that horizontal plane as the canister so revolves. Finally, the apparatus includes means for driving the canister in revolution around its longitudinal axis. In one species, the mounting means includes a yoke within which the canister is seated to so revolve, and the driving means also effects rotation of that yoke around the transverse axis. In another species, the mounting means includes a gimbal ring within which the canister is pivotally mounted so as to rotate around the transverse axis.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 13:
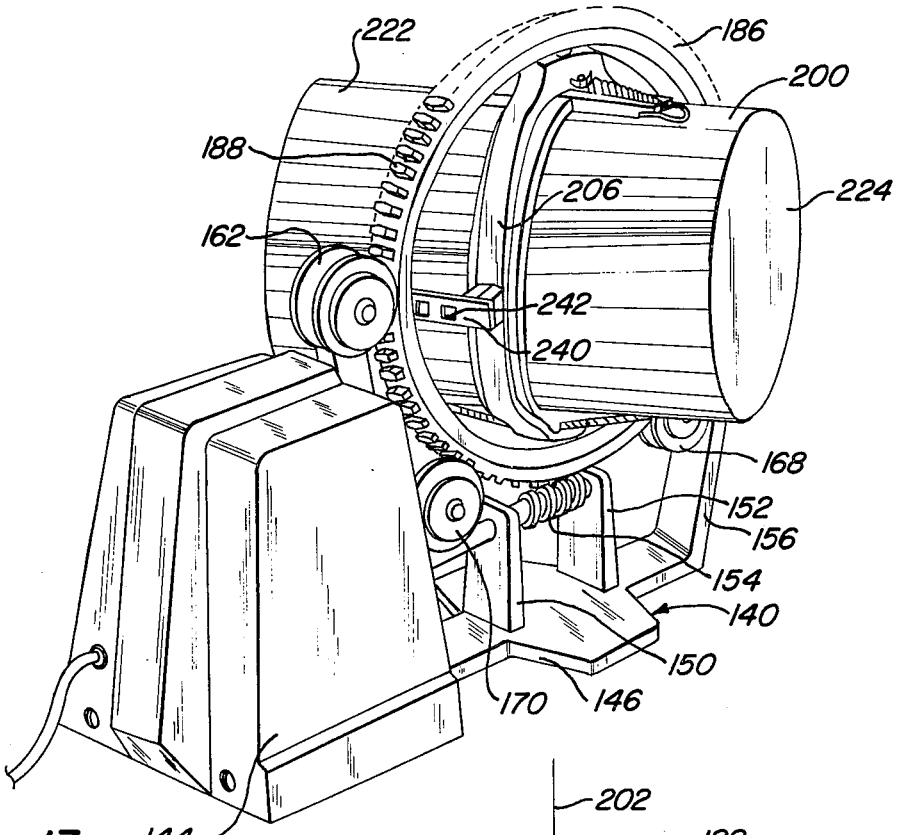
FIG. 13 is a perspective view of another form of rock tumbling apparatus.
Figure 14:
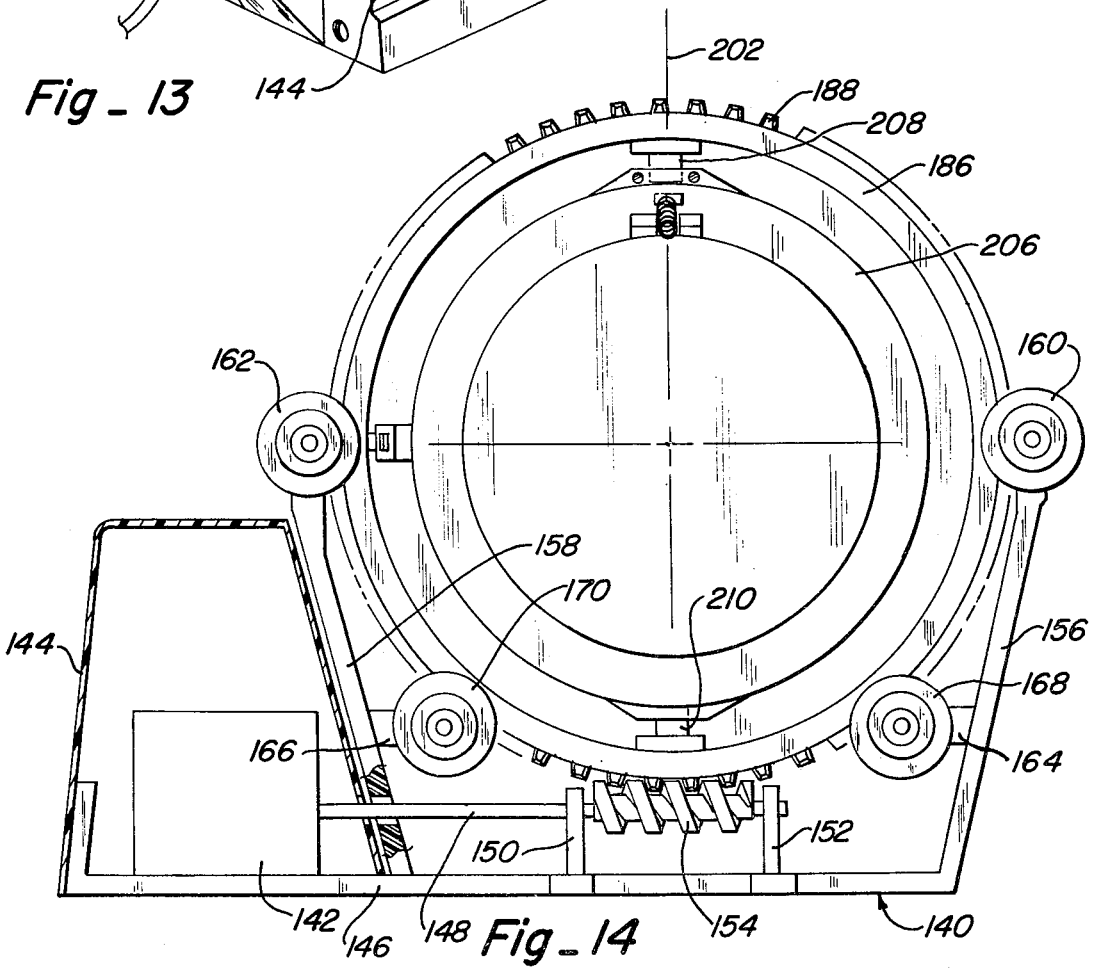
FIG. 14 is a view of a vertical cross section taken essentially through the apparatus of FIG. 13 and with a principal component moved to a different position.
Figure 15A:
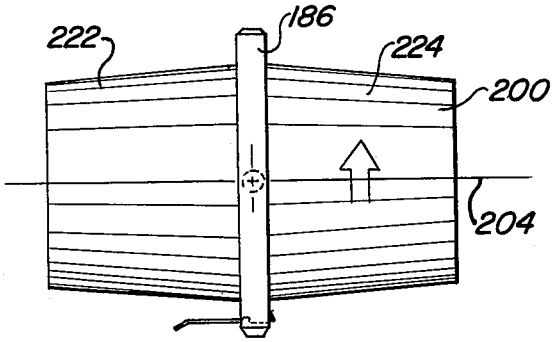
Figure 16:
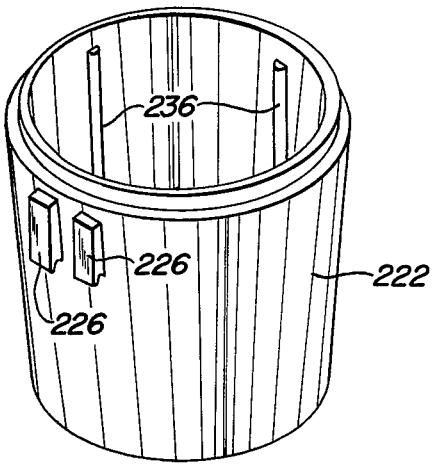
Figure 15B:
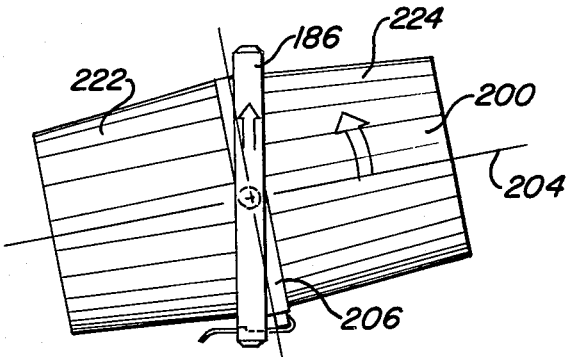
Figure 15C:
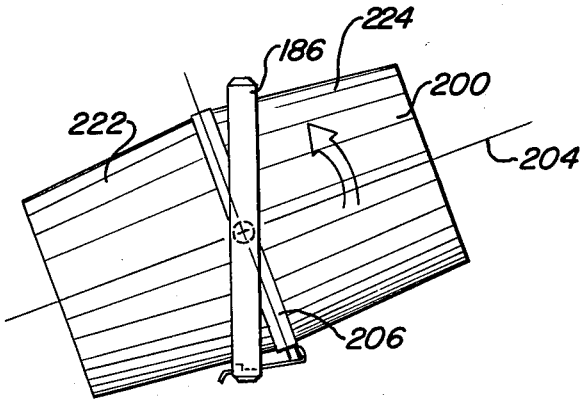
Figure 17:
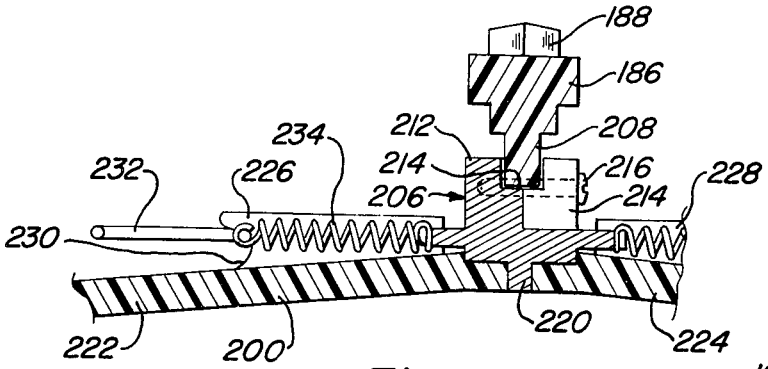
Figure 20:
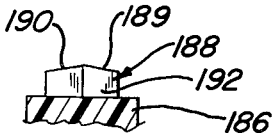
Figure 18:
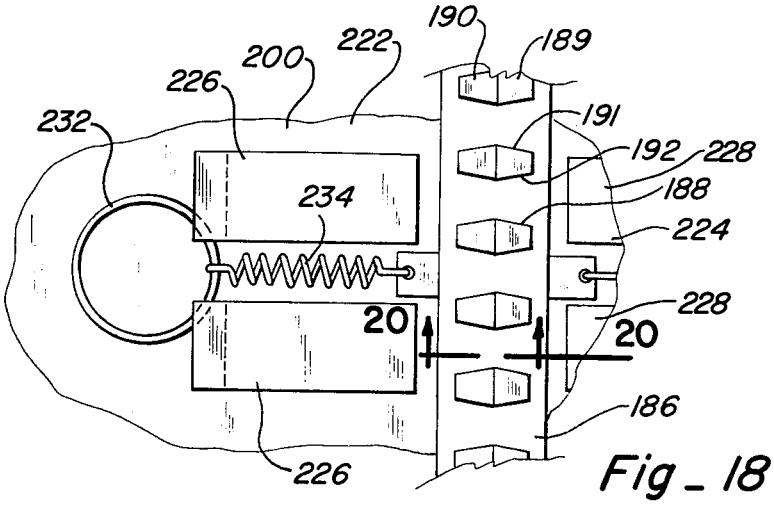
Figure 19:
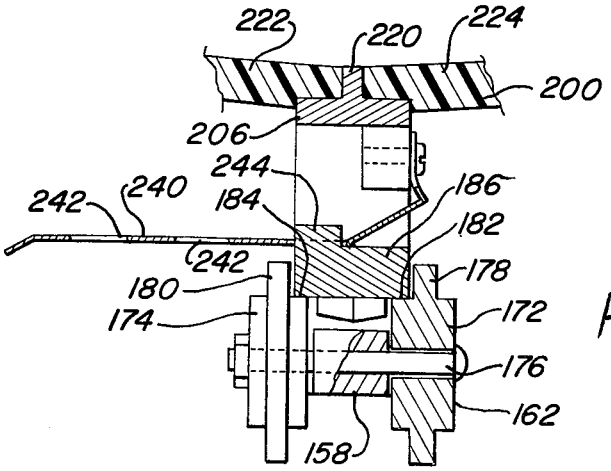

FIGS. 15*a*, 15*b*, and 15*c* are generally schematic views of components included within the apparatus shown in FIG. 13 and illustrating respective different selectable positions of a principal component thereof;

FIG. 16 is a perspective view of a subcomponent shown in FIG. 13;

FIG. 17 is an enlarged fragmentary cross-sectional view of a component assembly included in the apparatus of FIG. 13;

FIG. 18 is a fragmentary plan view of the subcomponent assembly shown in FIG. 17;

FIG. 19 is a fragmentary cross-sectional view of a portion of the apparatus shown in FIG. 13; and FIG. 20 is a fragmentary cross-sectional view taken along the line 20—20 in FIG. 18.

Figure 1:
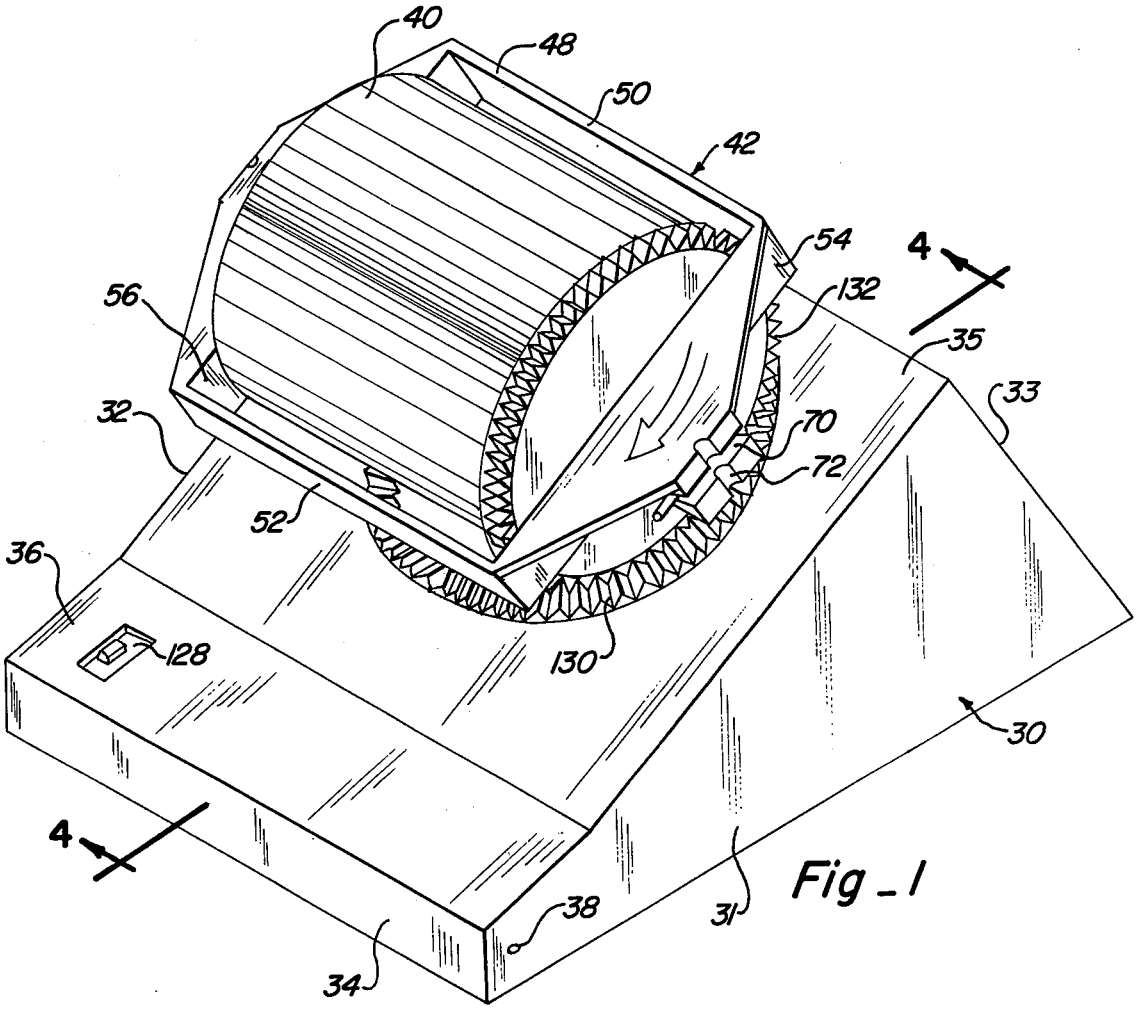
FIG. 1 is a perspective view of a first form of tumbling apparatus.
Figure 2:
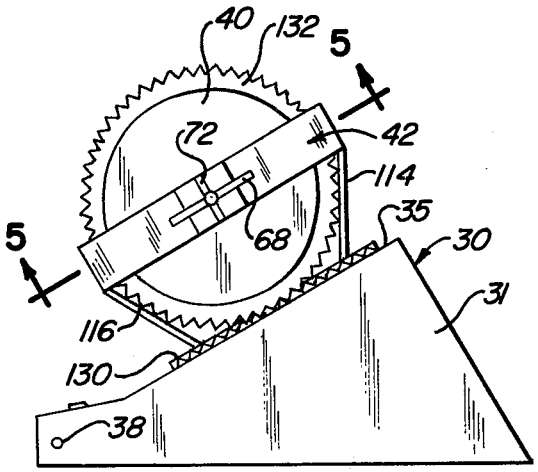
FIG. 2 is a side-elevational view of the apparatus shown in FIG. 1.
Figure 3:
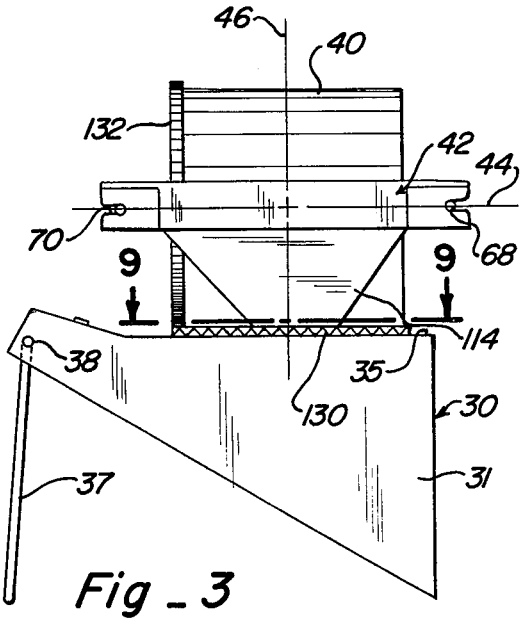
FIG. 3 is a view similar to that of FIG. 2 but with certain of the components in a different position.
Figure 4:
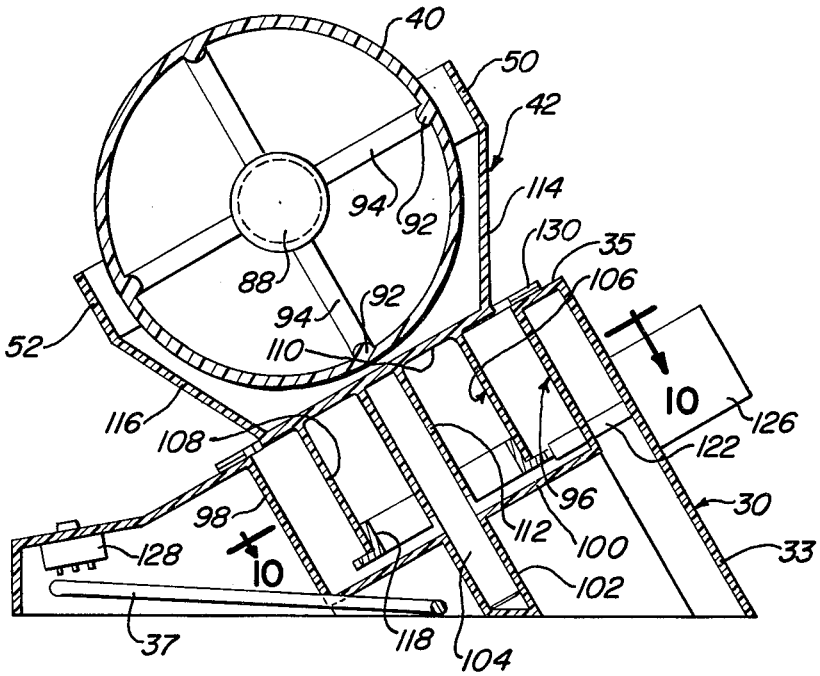
FIG. 4 is a cross-sectional view taken along the line 4—4 in FIG. 1.
Figure 5:
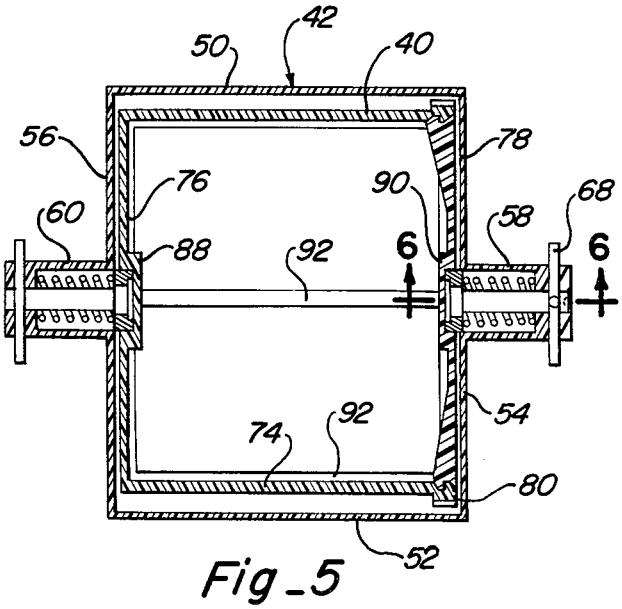
FIG. 5 is an enlarged cross-sectional view taken along the line 5—5 in FIG. 2.

In the embodiment of FIGS. 1–12, a base assembly 30 includes opposing sidewalls 31 and 32, a rear wall 33 and a front wall 34. Closing the upper side of the base assembly is a main top panel 35 which extends from the upper edge of rear wall 33 into merger with a forward top panel 36 that terminates at the upper edge of wall 34. In the mode of orientation of base assembly 30 illustrated in FIGS. 1, 2 and 4, main top panel portion 35 slants downwardly from rear wall 33 at an angle of approximately thirty degrees relative to a horizontal plane, while forward top panel portion 36 slants onwardly at a lesser angle. In another mode of orientation of the base assembly as illustrated in FIG. 3, the forward end of the base assembly is tilted up so that main top panel portion 35 lies in a horizontal plane. This latter orientation is maintained by a leg stand 37 when swung out to its position as shown in FIG. 3 from its storage position as shown in FIG. 4. In this case, legstand 37 is simply formed of a length of stiff wire bent into the general shape of a U with its free end portions bent outwardly so as to snap into respective apertures 38 formed in corresponding sidewalls 31 and 32 in a position spaced a short distance behind front wall 34. Thus, the bight of the U-shaped stand runs parallel to front wall 34 and extends from one side to the other of base assembly 30.

An at least generally-cylindrical canister 40 is mounted within a yoke assembly 42 in a manner permitting canister 40 to revolve around its longitudinal axis 44 (FIG. 3). In turn, yoke assembly 42 is so supported from base assembly 30 as to be rotatable about a transverse axis 46 (FIG. 3) which intersects longitudinal axis 44 at a right angle thereto and thus also extends laterally through at least approximately the center of canister 40. In more detail, yoke assembly 42 includes a generally rectangular frame 48 having space-opposed sides 50 and 52 joined by respective ends 54 and 56. Formed into ends 54 and 56 are respective outwardly-projecting bearing sleeves 58 and 60. Since the two resulting bearing assemblies are in this case identical, only the one of which sleeve 58 forms a part is enlarged in FIGS. 6 and 7 for purposes of explanation.

Figure 6:
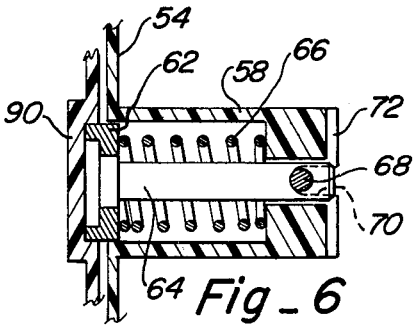
FIG. 6 is an enlarged and fragmentary cross-sectional view taken along the line 6—6 in FIG. 5.
Figure 7:
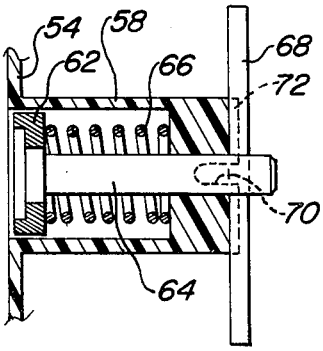
FIG. 7 is a view similar to that of FIG. 6 but with certain of the components in a different position.
Figure 8:
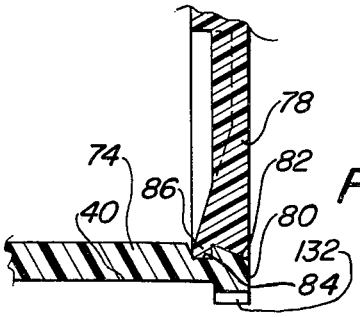
FIG. 8 is an enlarged fragmentary view of a portion of the apparatus shown in FIG. 5.
Figure 9:
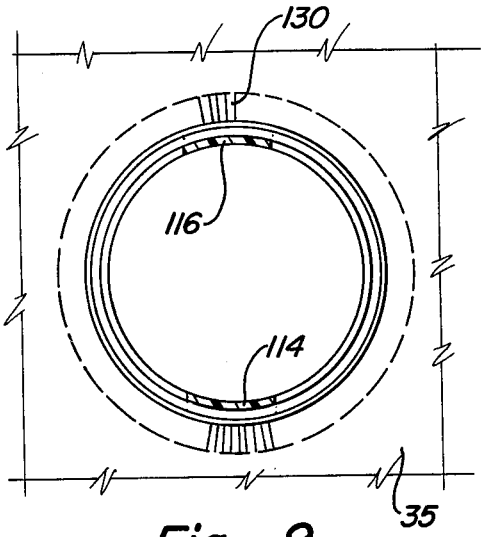
FIG. 9 is a fragmentary cross-sectional view taken along the line 9—9 in FIG. 3.
Figure 10:
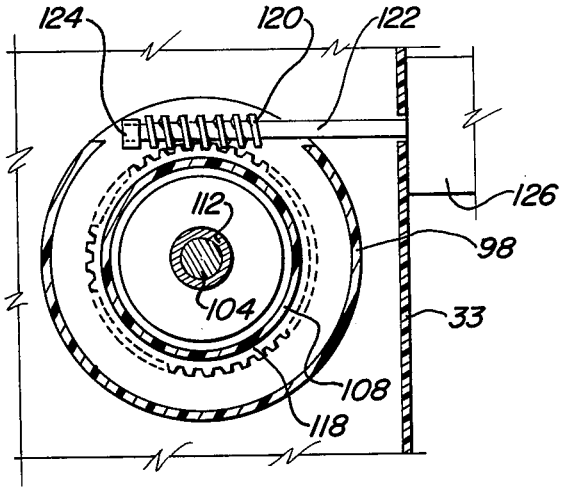
FIG. 10 is a fragmentary cross-sectional view taken along the line 10—10 in FIG. 4.
Figure 11:
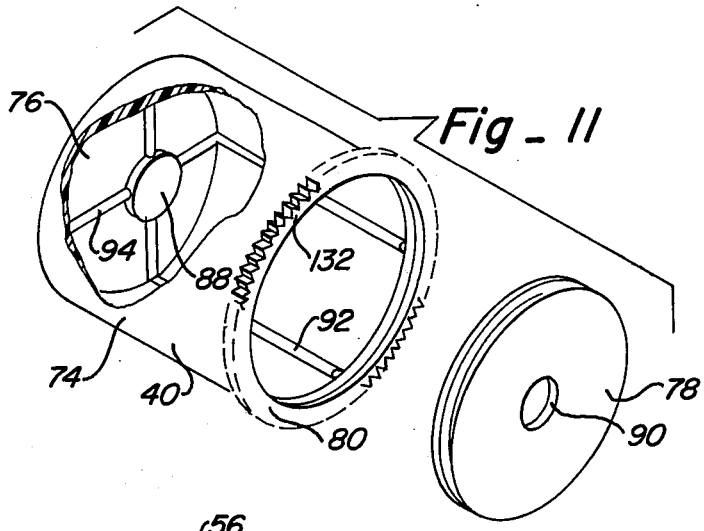
FIG. 11 is an exploded perspective view, partially broken away, of a component included in the apparatus of FIG. 1.
Figure 12:
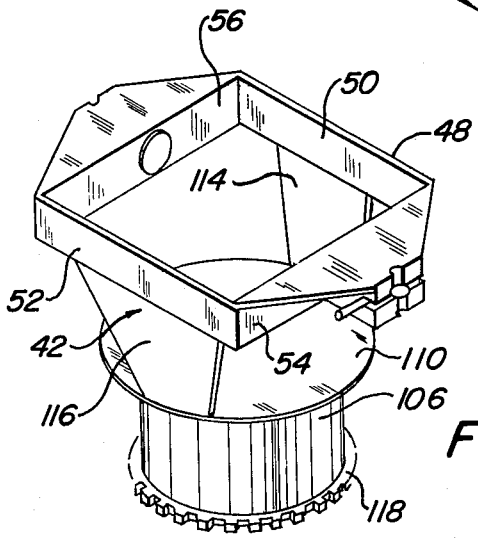
FIG. 12 is a perspective view of another component shown in the apparatus of FIG. 1.

Carried within sleeve 58 is a bearing 62 integral with an outwardly-projecting spindle 64 the end portion of which opposite bearing 62 itself slides within a necked-down outer portion of sleeve 58. A compression spring 66, encircling pin 54 and disposed between that necked down portion and bearing 62, serves to bias the latter in an inward direction relative to the frame assembly. A pin 68 is force fit within a transverse opening through spindle 64 near its outer end. In the position illustrated in FIG. 6, pin 68 is seated within a transverse groove 70 depressed into the outer end surface of sleeve 58. In this position of pin 68, spring 66 urges bearing 62 to a position in which the latter projects partially beyond and inwardly from end 54 of the yoke frame. Also formed into the outer end face of sleeve 58 is another transverse groove 72 at right angles to and of shallower depth than groove 70. By pulling pin 68 outwardly from groove 70 and rotating the pin by ninety degrees about the axis of spindle 64, pin 68 is caused to rest in groove 72 as shown in FIG. 7. In this condition, bearing 62 is held in a withdrawn position so as to lie entirely within sleeve 58.

Canister 40 has a main body which is in the general shape of a cup, having a cylindrical sidewall 74 closed at one end by a bottom wall 76. Closing the other end, opposite bottom wall 76, is a cover 78. As detailed in FIG. 8, the inner surface of wall 74 adjacent to the rim 80 of the defined cup is shaped to form a cam surface 82 followed by a lateral recess 84. The outer rim of cover 78 is matingly shaped to define a radially-extending rib 86 inside of a canted surface that corresponds with cam surface 82. At least the material from which sidewall 74 is formed, and preferably also cover 78, is sufficiently resilient to enable cover 78 simply to be snapped into a closing condition with rib 86 seated within recess 84.

Concentrically formed into the exterior surfaces of each of bottom wall 76 and cover 78 are respective hubs 88 and 90. Each hub has a diameter and depth sized to seat the corresponding one of bearings 62 when those bearings are in the inward location as illustrated in FIG. 6. Thus, the assembled canister is lockingly seated within the frame assembly and supported by bearings which permit canister 40 to revolve around its longitudinal axis 44. Projecting inwardly into the interior of canister 40 are a plurality of circumferentially-spaced ribs 92 that run lengthwise along the inner surface of wall 74 and merge into transverse ribs 94 on the inner surface of bottom wall 76. These ribs assist in agitation of that which is to be contained within canister 40.

Depending inwardly of base assembly 30 from top panel portion 35 is a well 96 having a cylindrical sidewall 98 and a bottom wall 100. Centrally projecting on beyond bottom wall 100 is a sleeve 102 within which is snugly seated the lower end portion of a spindle 104. Carried upon the upper end portion of spindle 104 for rotation thereabout is a drum 106 which has a cylindrical sidewall 108 closed across its generally upper end by an end wall or mounting plate 110. Projecting inwardly and centrally of the drum from plate 110 is a sleeve 12 that is slidingly received upon pin 104. Slanting downwardly and inwardly from the midportions of sides 50 and 52 are respective struts 114 and 116 which connect to space-opposed margins of plate 110 and thus serve to support frame assembly 48 from drum 106.

Situated within the lower rim or margin of drum 106 is a ring gear 118 having teeth which project radially outward. Matable with and serving to drive gear 118, and hence drum 106, in rotation around pin 104 is a worm 120 formed on a shaft 122 and received at its outer end in a bearing 124. As a motive element for ultimately effecting all movement, shaft 122 could be driven in rotation by any suitable means, including even a hand crank or the like. Because of the still-substantial operational times involved, however, shaft 122 in this case is driven by an electrical motor 126 mounted on the exterior of rear wall 33 and through which shaft 122 projects. Preferably, motor 126 is energized and deenergized by means of a switch 128 located in forward top panel portion 36.

Affixed on the exterior surface of main top panel portion 35, and disposed concentrically around the rim of well 96, is a circular spur gear 130 that has its teeth facing canister 40. Mating with gear 130 is another spur gear 132 formed around the outer margin of rim 80 of canister 40. In operation, the motive power supplied through shaft 122 serves through worm 120 and gear 118 to rotate yoke assembly 42, and consequently also to rotate canister 40, about transverse axis 46. At the same time, canister 40 is slaved to that movement, through gears 130 and 132, so that the canister also is rotated about its longitudinal axis 44. When leg stand 77 is swung downwardly to the position shown in FIG. 3, the orientation of longitudinal axis 44 remains in a horizontal plane as canister 40 revolves about that longitudinal axis. On the other hand, when leg stand 37 is swung upwardly to its storage position as shown in FIG. 4, longitudinal axis 44 is in a second position wherein it wobbles relative to the horizontal plane as the canister continues to revolve. With this latter orientation, the tumbling or agitation action within canister 42 is greatly increased. Thus, leg stand 37 serves to permit a canting of transverse axis 46 into and out of a vertical position with a resultant change as between minimal and maximum tumbling effect.

Except, of course, for motor 126, switch 128 and compression spring 66, all parts may be fabricated from suitable plastic materials. In particular, the entirity of base assembly 30, including well 96, may be molded as a single, integral component. Also in particular, gear 132 preferably is formed integrally as a part of the wall of canister 40. Gear 130 may be either an integral portion formed into top panel portion 35 or be a metallic or suitable plastic ring secured to that top panel portion. Analogously, gear 118 may be formed integrally on the lower end of drum 106, although increased durability contemplates the construction of that gear as a separate part fabricated from an appropriate plastic or from metal. At present, worm 120 preferably is metallic. The entirity of yoke assembly 42, including all portions of the bearing assemblies and spindles, preferably are formed of plastic. However, the use of metallic parts in the fabrication of the major driving components may be employed.

In usage for such purposes as rock tumbling, it often is desired to continue operation for substantial periods of time during which it is not desired that an operator be continuously present. Accordingly, the described utilization of gear mechanisms is preferred in order to obtain a most positive type of mechanical drive train. However, it is to be observed that other drive-train mechanisms may be substituted. Included could be known friction drives such as belts and pulleys or rollers. For example, gear 132, on the rim of canister 40, might be in the form of a rubber roller which would frictionally engage the upper surface of main top panel 35. Still differently, a wheel, or linkage of wheels, might be frictionally coupled between a longitudinal shaft for canister 40 and surface 35.

Particularly for heavier duty or larger units, the embodiment of FIGS. 13–20 is preferred. Included therein is a base assembly 140 on one side of which is mounted an electric motor 142 enclosed within a housing 144 upstanding from a base plate 146. Projecting outwardly from motor 142 is a motive drive shaft 148 the outer end portion of which is supported for rotation within apertures formed in a pair of ears 150 and 152 spaced apart longitudinally of shaft 148 and fixedly projecting upwardly from plate 146. Extending between ears 150 and 152 and formed or secured upon shaft 148 is a worm 154. Projecting rigidly upward from plate 146 and slanting mutually outwardly from one another are a pair of space-opposed arms 156 and 158 upon the upper end of which are journaled laterally-grooved rollers 160 and 162, respectively. Projecting inwardly from each of arms 156 and 158, in respective locations beneath rollers 160 and 162, are corresponding struts 164 and 166 on the inner ends of which are journaled respective rollers 168 and 170. As best shown in FIG. 19 for roller 162, each roller is composed of a pair of discs 172 and 174 spaced on opposing sides of the respective arm or strut (the upper end portion of arm 158 in the case of FIG. 19) and journaled upon an axle 176 which, in this case, is simply a bolt held in position by a nut. Each disc 172 and 174 includes a circumferential, radially-extending respective rib 178 and 180 projecting from only the central region of the otherwise lateral wall of the corresponding disc and so as to form respective shoulders 182 and 184.

Resting within the grooves, thus defined by ribs 178 and 180 and shoulders 182 and 184 of all of rollers 160, 162 and 168, 170, is a gimbal ring 186. Ring 186 carries a succession of circumferentially spaced teeth 188 that face outwardly and mate with worm 154. As perhaps best shown in FIGS. 18 and 20, each of teeth 188 has its own special shape and profile. Each tooth 188 is so formed as to define a pair of back-to-back outwardly facing facets 189 and 190 each of which is outwardly inclined inwardly of ring 186. Moreover, each tooth 188 has space-opposed radially-extending sidewalls 191 and 192, beneath each facet, that converge in a direction laterally-outward of ring 186. The usual ring-gear tooth that cooperates with a driving worm is formed to be concave inwardly of the ring radially and is capable of cooperating with the worm only in one orientation of the ring gear. With the formation of the teeth as hereindescribed and illustrated, however, proper mating between the teeth and worm 154 is achieved regardless of which of the two possible 180°-displaced orientations of gear 186 is selected or happens to be used. Again referring to FIG. 19, teeth 188 project from the central region of the perimeter of gear 186 so as to leave space-opposed marginal shoulders that ride on shoulders 182 and 184 of the supporting rollers.

Supported within gimbal ring 186 is a canister 200 pivotally mounted so as to be rotatable around a transverse axis 202 which extends laterally and centrally through canister 200 and, as before, intersects at right angles a longitudinal axis 204 of the canister itself. In more detail, canister 200 is carried by a yoke ring 206. Projecting inwardly from space-opposed locations on gimbal ring 186 are a pair of integral pivot posts 208 and 210. As best shown in FIG. 17, yoke ring 206 includes an outwardly projecting flange 212 that includes the formation of an inner notch 214 into which post 208 is partially seated. Completing the captivation of the lower end portion of post 208 is a clamping member 214, having a mating notch, that is secured to flange 212 by means of a screw 216 threaded into the flange. Post 210 is similarly secured at the other side of yoke ring 206.

Projecting inwardly from yoke ring 206 is a circumferential rib 220. Canister 200 is in itself composed of a pair of complementary half shells 222 and 224 each of which is generally cup shaped and has a lip formed to engage with yoke ring 206 and seat against a respective lateral surface of rib 220. The sidewalls of cups 222 and 224 each carry circumferentially-spaced pairs of outstanding lug pairs 226 and 228, respectively, having corresponding undercut grooves 230 that cooperate to captivate a ring 232 in each case affixed on the end of a spring 234 anchored to yoke ring 206 at a point in alignment between each such lug pair. Thus, by disposing cups 220 and 224 in complemental relationship with their rims seated against rib 220, and then seating rings 232 within grooves 230, the two cup sections are caused to be mounted on yoke ring 206 in a manner so as to define canister 200. The strength of springs 234 is selected to seal the rims of cups 222 and 224 against the rib 220 so as to prevent the egress of liquid at that point, while at the same time permitting the egress of gases formed within canister 200. In analogy to the formation of canister 40 described in connection with the earlier embodiment, each of cups 222 and 224 include inwardly directed ribs 236 (FIG. 16).

Selectively fixing the amount of rotation of canister 200 around axis 202 and relative to gimbal ring 186 is a strap 240 affixed at one end to a portion of yoke ring 206, as shown in detail in FIG. 19, and including along its length a plurality of apertures 242. Projecting inwardly from gimbal ring 186 opposite strap 240 is a stub 244 sized to fit within any one of apertures 242. By selecting which one of apertures 242 is to be engaged over stub 244, the user is enabled to select the amount by which longitudinal axis 204 of canister 200 is canted. Thus, strap 240 serves as a means for adjusting the orientation of longitudinal axis 204 between a first position wherein that longitudinal axis remains in a horizontal plane as the canister is driven in revolution by gimbal ring 186 and a second position wherein longitudinal axis 204 wobbles relative to the horizontal plane as the canister continues to revolve.

As in the case of the previously-described embodiment, many of the components, including half shells 222 and 224, gimbal ring 186, housing 144 and integrally related parts such as lugs 226 and 228, are formed of a suitable plastic. In particular, shells 222 and 224 desirably are fabricated from an injected-molded rubber. Base assembly 140, worm 154, shafts 148 and various different springs and retaining elements may be of a metallic nature. However, even base assembly 140 preferably is of plastic.

In operation, the embodiment of FIGS. 13–20 again features a generally-cylindrical canister with respect to which there is defined both a longitudinal axis and a transverse axis which intersects that longitudinal axis at a right angle thereto. The canister is so driven as to include a component of revolution about the longitudinal axis. In this case through the provision of strap 240 and its coacting elements, the orientation of the longitudinal axis of the canister is adjustable as between a first position, in which the longitudinal axis remains in a horizontal plane as the canister revolves about such longitudinal axis, and a second position wherein the longitudinal axis wobbles relative to the horizontal plane during such revolution. FIGS. 15*a* through 15*c* illustrate possible differences in orientation of canister 200 relative to gimbal ring 186, FIG. 15*a*, of course, being the one in which there is no wobble of longitudinal axis 204 during operation and FIG. 15*c* showing the relative positions for obtaining a maximum degree of such wobble and thus much increased tumbling action.

In both embodiments, the canister wobbles about the intersection of longitudinal and horizontal axes. This reduces any tendency of the contained materials to gravitate toward one end of the canister. Also in both embodiments, the mounting and adjustment provisions enable either both revolving and rocking of the canister or selective only revolution thereof. In the embodiment of FIGS. 13–20, it will be observed that ring 186 constitutes a bearing that supports canister 200 for revolution about a longitudinal axis. Yoke 206 enables a canister 200 to be oriented in a position so as to rock about a transverse axis which extends through that bearing. Thus, canister 200 is driven in simultaneous revolution and rocking about respective axes.

A basic feature of both embodiments is that of enabling ultimate treatment to be completed within less time than that available by typical existing equipment. Thus, a more violent action may be utilized as when it is desired in first stages to eliminate sharp edges from rocks or stones. On the other hand, a change in the amount of "wobble" or compound movement of the longitudinal axis about which the canister is enabled, so as to be more consistent with the desired manner of operation during final polishing stages in which stone-contact blemishes otherwise might tend to appear in polished surfaces. The latter is particularly true in the case of polishing softer minerals. The orbital-type action experienced when the longitudinal axis of the canister is caused to wobble most violently prevents or at least minimizes any tendency to channalize the tumbling and actually forces the materials to work against each other more violently. Of course, that reduces the total time necessary for a particular operation. On the other hand, the flexibility provided permits a later, continued tumbling action with lesser interaction as between the stones or other objects themselves.

Typical usage in rock polishing involves the successive employment of different abrasive compounds placed within the canisters. These often range from silicon carbide for rough finishing down to various oxides for final smoothing. In many cases, gaseous products are developed as a result of the action. The arrangement of the embodiments of FIGS. 13–20 is especially desirable in permitting the escape of such gases while containing the basic materials.

With either embodiment, the unit may be supplied with a plurality of canisters, each having a different color to serve as a coding. Often, the user will desire to employ a separate canister in connection with tumbling that incorporates the usage of each different abrasive material that corresponds to a difference in ultimate finish.

While particular embodiments of the invention have been shown and described, and other modifications have been suggested, it will be obvious to those skilled in the art that changes and further modifications may be made without departing from the invention in its broader aspects and, therefore, the aim in the appended claims is to cover all such changes and modifications as fall within the true spirit and scope of the invention.

I claim:

1. Tumbling apparatus comprising:

a generally-cylindrical canister having a longitudinal axis and a transverse axis intersecting said longitudinal axis at a right angle thereto;

means for mounting said canister to revolve around said longitudinal axis;

means for adjusting the orientation of said longitudinal axis between a first position wherein said longitudinal axis remains in a horizontal plane as said canister revolves about said longitudinal axis and a second position wherein said longitudinal axis wobbles relative to said plane as said canister so revolves;

and means for driving said canister in revolution around said longitudinal axis.

2. Apparatus as defined in claim 1 which further includes means for prohibiting egress from said canister of liquids contained therein while permitting the egress of gases from within said canister.

3. Apparatus as defined in claim 1 in which said mounting means includes a yoke within which said canister is seated to revolve around said longitudinal axis.

4. Apparatus as defined in claim 3 in which said driving means also effects rotation of said yoke around said transverse axis.

5. Apparatus as defined in claim 1 wherein said mounting and adjusting means enable either both revolving and rocking of said canister or selective only revolving of said canister.

6. Apparatus as defined in claim 1 in which said mounting means includes a gimbal ring within which said canister is pivotally mounted to rotate around said transverse axis.

7. Apparatus as defined in claim 6 in which said adjusting means effects a selective degree of rotation of said longitudinal axis around said transverse axis.

8. Apparatus as defined in claim 6 in which said driving means effects rotation of said gimbal ring around its own axis.

9. Apparatus as defined in claim 8 in which said gimbal ring carries a peripheral succession of external teeth, and in which said driving means includes a worm matable with said teeth.

10. Apparatus as defined in claim 9 in which each of said teeth is formed to define a pair of back-to-back outwardly-facing facets each outwardly inclined inwardly of the ring and each having radially-extending sidewalls that, beneath each facet, converge in a direction laterally-outward of the ring.

11. Apparatus as defined in claim 8 in which said mounting means further includes a plurality of rollers spaced around the lower portion of the periphery of said gimbal ring and upon which said gimbal ring is removably seated.

12. Apparatus as defined in claim 1 in which said canister includes a pair of mutually-facing cup-shaped halfshells of at least approximately equal depth.

13. Apparatus as defined in claim 12 which further includes releasable means for resiliently clamping the lip portions of said half shells toward one another.

14. Apparatus as defined in claim 13 in which the resilient force exerted by said clamping means is of an amount sufficient to preclude the egress of liquid from said canister while permitting the egress of gas therefrom.

15. Apparatus as defined in claim 13 in which said mounting means further includes a yoke ring pivotally mounted within a gimbal ring to rotate around said transverse axis, and in which said releasable means clamps said lip portions against respectively opposite faces of said yoke ring.

16. Tumbling apparatus comprising:

a generally-cylindrical canister having a longitudinal axis and a transverse axis intersecting said longitudinal axis at a right angle thereto;

means for mounting said canister to revolve around said longitudinal axis;

means for driving said canister is revolution around said longitudinal axis;

and means for enabling orientation of said canister in a position wherein said longitudinal axis wobbles relative to a horizontal plane, and about the intersection of said axes, as said canister so revolves.

17. Tumbling apparatus as defined in claim 16 in which said enabling means alternatively permits orientation of said canister in a position wherein said longitudinal axis remains in said plane as said canister so revolves.

18. Tumbling apparatus comprising:

a generally-cylindrical canister having a longitudinal axis and a transverse axis intersecting said longitudinal axis at a right angle thereto;

means for mounting said canister to revolve around said longitudinal axis;

means for adjusting the orientation of said longitudinal axis between a first position wherein said longitudinal axis remains in said horizontal plane as said canister revolves about said longitudinal axis and a second position wherein said longitudinal axis exhibits a compound movement relative to said plane as said canister so revolves;

and means for driving said canister in revolution about said longitudinal axis when adjusted to said orientation in either of said first or second positions.

19. Apparatus as defined in claim 18 which further includes means for prohibiting egress from said canister of liquids contained therein while permitting the egress of gases from within said canister.

20. Apparatus as defined in claim 18 in which said mounting means includes a yoke within which said canister is seated to revolve around said longitudinal axis.

21. Apparatus as defined in claim 20 in which said driving means also effects rotation of said yoke around said transverse axis.

22. Apparatus as defined in claim 21 in which said adjusting means changes the orientation of said transverse axis between a vertical position and a position canted with respect to vertical.

23. Apparatus as defined in claim 22 in which said mounting means further includes a base assembly upon which said yoke is carried, and in which said adjusting means effects a tilting of said base assembly relative to said horizontal plane.

24. Apparatus as defined in claim 21 in which said mounting means further includes a base assembly upon which said yoke is carried, in which said driving means includes a motive element directly connected to said yoke for driving the same in said rotation around said transverse axis, and in which said driving means further includes means mechanically coupling said canister to said base assembly for effecting revolution of said canister around said longitudinal axis in response to said rotation around said transverse axis.

25. Apparatus as defined in claim 24 in which said coupling means includes a first spur gear carried on the periphery of one end of said canister and matable with a second spur gear fixed on said base assembly in a position concentric with said transverse axis.

26. Apparatus as defined in claim 24 in which said motive element includes a worm and in which an externally-toothed ring gear, fixedly carried by said yoke, mates with said worm.

27. Apparatus as defined in claim 18 in which said mounting means includes a bearing supporting said canister for revolution about said longitudinal axis and enabling said canister to rock about a transverse axis that extends through said bearing, said driving means simultaneously revolving and rocking said canister about respective axes.

28. Apparatus as defined in claim 18 wherein said mounting and adjusting means enable either both revolving and rocking of said canister or selective only revolving of said canister.

29. Apparatus as defined in claim 18 in which said canister includes a pair of mutually-facing cup-shaped halfshells of at least approximately equal depth.

30. Apparatus as defined in claim 29 which further includes releasable means for resiliently clamping the lip portions of said half shells toward one another.

31. Apparatus as defined in claim 30 in which the resilient force exerted by said clamping means is of an amount sufficient to preclude the egress of liquid from said canister while permitting the egress of gas therefrom.

32. Apparatus as defined in claim 18 in which said driving means effects both said revolution of said canister around said longitudinal axis and revolution of said canister around said transverse axis.

33. Tumbling apparatus comprising:

a generally-cylindrical canister having a longitudinal axis and a transverse axis intersecting said longitudinal axis at a right angle thereto;

means for mounting said canister to revolve around said longitudinal axis;

means for driving said canister in revolution around said longitudinal axis;

and means for enabling orientation of said canister in a position wherein said longitudinal axis exhibits a compound movement relative to a horizontal plane, and about the intersection of said axes, as said canister so revolves.

34. Tumbling apparatus as defined in claim 33 in which said enabling means alternately permits orientation of said canister in a position wherein said longitudinal axis remains in said plane as said canister so revolves.

35. Apparatus as defined in claim 33 in which said driving means also effects revolution of said canister around said transverse axis.

* * * * *